US011371730B2

(12) United States Patent
Loercher et al.

(10) Patent No.: US 11,371,730 B2
(45) Date of Patent: Jun. 28, 2022

(54) FAN SYSTEM AND ARRANGEMENT OF ONE OR MORE SUCH FAN SYSTEMS IN A FLOW DUCT

(71) Applicant: ZIEHL-ABEGG SE, Künzelsau (DE)

(72) Inventors: Frieder Loercher, Braunsbach (DE); Matthias Goeller, Weißbach (DE); André Mueller, Forchtenberg (DE)

(73) Assignee: ZIEHL-ABEGG SE, Künzelsau (DE)

( * ) Notice: Subject to any disclaimer, the term of this patent is extended or adjusted under 35 U.S.C. 154(b) by 223 days.

(21) Appl. No.: 16/473,228

(22) PCT Filed: Nov. 30, 2017

(86) PCT No.: PCT/DE2017/200122
§ 371 (c)(1),
(2) Date: Jun. 24, 2019

(87) PCT Pub. No.: WO2018/113855
PCT Pub. Date: Jun. 28, 2018

(65) Prior Publication Data

US 2019/0353364 A1 Nov. 21, 2019

(30) Foreign Application Priority Data

Dec. 23, 2016 (DE) ..... 102016226157.6

(51) Int. Cl.
*F24F 7/06* (2006.01)
*F04D 29/44* (2006.01)
(Continued)

(52) U.S. Cl.
CPC ..... *F24F 7/065* (2013.01); *F04D 29/44* (2013.01); *F24F 11/0001* (2013.01);
(Continued)

(58) Field of Classification Search
CPC ..... F24F 7/065; F24F 11/0001; F04D 29/44; F04D 29/626; F04D 29/664;
(Continued)

(56) References Cited

U.S. PATENT DOCUMENTS 3,511,162 A * 5/1970 Truhan ..... F24F 3/163 454/187
4,917,713 A * 4/1990 Helmus ..... B01D 46/10 55/385.2
(Continued)

FOREIGN PATENT DOCUMENTS

CN 205618410 U 10/2016
DE 3513902 A1 10/1985
(Continued)

*Primary Examiner* — Edelmira Bosques
*Assistant Examiner* — Dana K Tighe
(74) *Attorney, Agent, or Firm* — Jason P. Mueller; FisherBroyles, LLP

(57) ABSTRACT

A disclosed fan system includes a housing having side walls, an inflow side, and an outflow side; a fan secured in the housing by a mounting; and a backflow blocker mounted to the side walls within the housing on the outflow side of the housing partially blocking a cross-sectional area of the outflow side. The backflow blocker is positioned approximately centrally in a flow path of the housing and is configured to block part of an airflow cross section such that, between side walls of the housing and side walls of the backflow blocker, an annular duct is formed as an air passage. Further, the backflow blocker has a thickness that is greater than 5% of a width of the housing, and is less than 20% of an axial design height of the fan system.

25 Claims, 17 Drawing Sheets

(51) Int. Cl.

| | |
|---|---|
| ***F24F 11/00*** | (2018.01) |
| *F04D 17/08* | (2006.01) |
| *F04D 25/06* | (2006.01) |
| *F24F 13/24* | (2006.01) |

(52) U.S. Cl.
CPC ..... *F04D 17/08* (2013.01); *F04D 25/06* (2013.01); *F24F 2013/242* (2013.01)

(58) Field of Classification Search
CPC .. F04D 29/667; F04D 29/703; F04D 29/4253; F04D 17/08; F04D 17/165; F04D 25/06; F04D 25/08
USPC ..... 454/185, 186, 187, 352
See application file for complete search history.

(56) References Cited

U.S. PATENT DOCUMENTS

| | | | | | |
|---|---|---|---|---|---|
| 5,297,326 | A * | 3/1994 | Kline | F24F 13/06 | 236/49.5 |
| 5,876,279 | A * | 3/1999 | Renz | F24F 3/167 | 454/187 |
| 5,884,500 | A * | 3/1999 | Wetzel | F24F 1/027 | 62/259.1 |
| 6,217,281 | B1 * | 4/2001 | Jeng | F04D 29/664 | 415/119 |
| 2006/0217056 | A1 * | 9/2006 | Gomi | F24F 1/0071 | 454/187 |

FOREIGN PATENT DOCUMENTS

| | | | |
|---|---|---|---|
| DE | 4021316 | A1 | 2/1991 |
| DE | 4129211 | A1 | 3/1993 |
| DE | 19523339 | A1 | 1/1996 |
| DE | 10351476 | B4 | 6/2005 |
| EP | 0497296 | B1 | 8/1992 |
| WO | 2016/173594 | A1 | 11/2016 |

* cited by examiner

FAN SYSTEM AND ARRANGEMENT OF ONE OR MORE SUCH FAN SYSTEMS IN A FLOW DUCT

CROSS-REFERENCE TO EXISTING APPLICATIONS

This application is a national stage entry under 35 U.S.C. 371 of PCT Patent Application No. PCT/DE2017/200122, filed Nov. 30, 2017, which claims priority to German Patent Application No. 102016226157.6, filed Dec. 23, 2016, the entire contents of each of which is incorporated herein by reference.

This disclosure relates to a fan system and to the arrangement of one or more such fan systems in a flow duct or a similar ventilation system, wherein, in the fan system, on the pressure side, a device for reducing or suppressing backflow of the outflowing air is provided.

The term "fan" should be understood in the broadest sense. As a rule, it relates here to radial, diagonal or axial fans. In the case of a modular use, such fans are arranged in housings or connected on the pressure side to flow ducts which convey the air flow usually in axial direction. Corresponding flow ducts are typically rectangular in cross section, in particular square or round.

In practice, the flow ducts often have a relatively small cross section in comparison to the fan diameter, or the side walls of the flow ducts which deflect the air flowing from the fan in axial direction are arranged relatively close to the fan outlet, whereby considerable flow losses occur in the case of free-wheeling fans. For example, in a square or rectangular duct, the distance between opposite side walls is equal to or smaller than 1.6 times the maximum fan blade diameter of a built-in fan. These flow losses are the result of the development of a backflow in a central area or an area near the axis behind the fan, which induces a large toroidal vortex. This leads to considerable power losses and noise generation. The losses are greater, the narrower or smaller the duct is constructed. In a very similar manner, losses result if adjacent radial or diagonal fans connected in parallel are at a small distance relative to one another and the outflowing air is thereby rapidly deflected in axial direction. In order to counteract these losses, it is already known from practice to remove the angular spin from the flow by using guide wheels, whereby flow losses can be reduced considerably. The use of guide wheels is expensive in terms of construction. In addition, due to the use of guide wheels, the noise emission is increased. Regarding existing systems, reference is made merely as an example to DE 195 23 339 A1 which in concrete terms shows an axial fan arranged in a housing with a guide wheel, whereby a stabilization of the air flow generated by the impeller wheel should occur. Correspondingly, the guide wheel is arranged on the pressure side of the fan.

From EP 0 497 296 B1, a generic arrangement is known, in which a fan is arranged in a housing. On the pressure side, multiple relatively thick intermediate walls are provided, which form two square concentrically arranged annular ducts with small flow cross section. On the pressure side, a filter is arranged downstream. The inner wall portions consist of sound-insulating material for the purpose of sound-insulating the unit. In addition, the annular ducts nested in one another are used for a uniform flow distribution.

In the above described arrangement, it is disadvantageous that the provision of the wall portions and the creation of relatively narrow annular ducts entails considerable flow losses. If the intermediate walls were not produced from sound-insulating material, considerable flow noise would be generated.

In addition, due to their geometry and arrangement, the intermediate walls have a considerable axial extent, so that together with the fan a considerable axial installation space is necessary. This is disadvantageous in particular if the fan is to be accommodated in a modular housing.

In light of the above explanations, the underlying aim of the disclosure is to largely eliminate the disadvantages known in conventional systems. Above all, while avoiding flow losses, a quiet operation should be possible. In addition, the fan system and the arrangement of fan systems should differ from competing products in design and in construction.

The above aim is achieved by the features of the coordinate claims 1 and 15. Accordingly, the fan system includes a fan which can be arranged in a housing. An arrangement consists of one or more fan systems arranged in a modular combination to form a fan wall and, depending on the embodiment, a flow duct or a similar ventilation system in which the fan system(s) is/are built in, wherein the flow duct in general has a rectangular, square or round cross section.

On the pressure side, a device for reducing or suppressing backflow is provided, which is used for evening out the outflowing air.

The device consists of a mechanical backflow blocker which is arranged approximately centrally in the flow path and blocks part of the flow cross section. The backflow blocker is a compact component per se which, in a relatively flat design, has only a small axial frame size.

In an advantageous design, the backflow blocker is designed as a plate or a flat box (flat design in axial direction), the effective surface of which extends transversely or orthogonally to the flow direction. The backflow blocker represents an obstacle in the flow path, but does not, by itself form any additional flow paths or flow ducts. With regard to the air flow, the backflow blocker itself has a closed design.

In another advantageous design, the backflow blocker has essentially the same or a similar contour or cross-sectional shape as the housing or the flow duct. This means that, for example in the case of a square flow duct, the backflow blocker has a square area. In the case of a flow duct which has a round cross section, the backflow blocker is accordingly provided with a round cross section.

In the context of a most particularly advantageous design, the backflow blocker has a central recess or a passage. In the built-in state of the backflow blocker, an area of the motor of the fan protrudes into this recess or through this recess, so that the backflow blocker can be arranged or positioned in such a manner that it does not protrude on the pressure side beyond the end of the fan. Such a design has the enormous advantage that, by the provision of the backflow blocker, the frame size of the arrangement is not increased in axial direction, and accordingly the arrangement can have at most the axial frame size of the fan. In addition, it is conceivable that the backflow blocker is designed in the manner of a frame, wherein, on the pressure side, the portion of the fan which protrudes into the backflow blocker or through the backflow blocker lies within the frame pieces and is shielded at least laterally. In addition, the peripheral frame promotes the formation of the flow path while avoiding vortexes.

The backflow blocker is advantageously dimensioned in such a manner that it reduces the effective flow cross section within the housing or within the flow duct by 40 to 70%. In further embodiments, the effective cross section may be approximately 50%.

With the backflow blocker, in comparison to conventional systems, a clearly lower speed dispersion and a homogeneous flow exposure of downstream components are achieved. Thereby, a reduced distance to downstream components such as, for example, a filter or a heat exchanger, is possible. The homogeneous flow pattern moreover promotes the functionality of the downstream components, namely due to the homogeneous flow exposure and this with at least less reduction of the pressure-side acoustics.

In principle, it is possible for the backflow blocker to be produced from a crimped or beveled metal plate. In the same way, said backflow blocker can be produced from plastic, forming a single part or multiple parts, wherein the individual parts of the backflow blocker are connected by joining to one another. Moreover, it is conceivable that the backflow blocker is entirely produced as a sound-absorbing component, for example, as a perforated metal plate with a back filling of sound-absorbing material, or from a dimensionally stable sound-absorbing material, for example, from a foamed plastic with open porosity.

The backflow blocker can have its own mounting which positions it in the housing or flow duct in accordance with the above embodiments. It is also conceivable for the backflow blocker to use an already existing mounting of the fan. The backflow blocker can be screwed to the mounting or clipped to the mounting or it can be snapped in or clamped there. Any non-positive/positive connections between the backflow blocker and the mounting are conceivable, wherein the fastening should be reversible, in order to facilitate access to the fan.

Here, it should be noted that such a backflow blocker can be removed without effort for fan maintenance or repair purposes. It is also conceivable to retrofit a generic arrangement with a backflow blocker, namely, for example, using the mounting of the fan, which is present in any case.

The particular mounting of the backflow blocker or the mounting of the fan used by the backflow blocker can consist of round stock, whereby flow conditions are promoted. In the context of a particularly simple design, the mounting can consist of a flat metal plate, for example, of sheet metal strips or sheet metal bars, and likewise of plastic.

In another advantageous embodiment, the flow function of the backflow blocker and the mechanical function of the fan mounting can be performed by one and the same part, that is, by a sheet metal part.

In a most particularly advantageous manner, the backflow blocker or the mounting of the fan can be shifted in its position in the housing or in the flow duct, namely along the mounting or along positioning rails which are associated with the mounting. In this manner, the otherwise identical fan system can be used without further measures with fans having different motors, different impeller frame sizes and impeller construction types which often have different design heights.

As already mentioned above, the backflow blocker can be produced from sheet metal or plastic, wherein the surface can be structured in order to promote the action of the backflow blocker. In the case of a production from plastic, this plastic can consist of foamed plastic with open porosity.

In another advantageous embodiment of a fan system, a pressure-side contact protection is formed, which, in addition to the backflow blocker, is necessary only in the areas which are not shielded by the backflow blocker.

The arrangement according to the disclosure consists of one or more adjacently arranged, parallel-connected fan systems, often arranged in flow ducts or similar ventilation systems. Since the fan systems have a backflow blocker, they can be positioned in a compact manner relatively close to one another or close to side walls of flow ducts, without entailing considerable flow losses. Such arrangements can be formed, as desired, from fan systems with or without housing, wherein the backflow blocker in any case deploys its positive effect. In fan systems with housing, adjacent fan systems can advantageously be connected to one another via the housing, in particular via the frame construction of the housing.

Any functional units desired can be arranged downstream of the backflow blocker, wherein the backflow blocker has a positive effect on said functional units to the extent that it brings about an evening out of the flow. Thus, a filter or a filter group or a heat exchanger or a heating unit can be arranged downstream.

Different possibilities then exist for designing and developing the teaching of the disclosure in an advantageous manner. For this purpose, reference is made, on the one hand, to the claims following claim 1 and, on the other hand, to the following explanation of embodiment examples of the disclosure in reference to the drawing. In connection with the explanation of the embodiment examples of the disclosure in reference to the drawing, designs and developments of the teaching in general are also explained. In the drawing, FIG. 1 shows, in a perspective view, an embodiment example of a fan system according to the disclosure, FIG. 2 shows, in a pressure-side top view, the fan system from FIG. 1, FIG. 3 shows, in a pressure-side top view, an additional embodiment example of a fan system according to the disclosure, without backflow blocker, with visible mounting of the fan, FIG. 4 shows, in a perspective view, the object from FIG. 3, but with mounted backflow blocker, FIG. 5 shows, in a pressure-side top view, the object from FIG. 4, FIG. 6 shows, in a side view, with side wall removed, the fan system from FIGS. 1 and 2, FIG. 7 shows, in a side view, with side wall removed, the fan system from FIGS. 3 to 5, FIG. 8 shows, in a perspective view from the suction side, an embodiment example of a fan system according to the disclosure, without housing, for installation in a flow duct, FIG. 9 shows, in a view from the pressure side, the embodiment example according to FIG. 8, FIG. 10 shows, in a side view, the object from FIGS. 8 and 9, FIG. 11 shows, in a pressure-side top view, the object from FIGS. 8 to 10, FIG. 12 shows, in a perspective view, an additional embodiment example of a fan system according to the disclosure in a housing with a sound absorber arranged downstream or integrated, FIG. 13 shows, in a pressure-side top view, the object from FIG. 12, FIG. 14 shows, in a side view, with side wall removed, the object from FIGS. 12 and 13, FIG. 15 shows, in a perspective view, an additional embodiment example of a fan system according to the disclosure with contact protection grate, FIG. 16 shows, in a perspective view, a compact arrangement of 4 parallel-connected fan systems, and FIG. 17 shows, in a perspective view, an additional embodiment example of a fan system according to the disclosure, in which the backflow blocker is integrated in the fan mounting.

FIG. 1 shows an embodiment example of a fan system 24 according to the disclosure, wherein a radial fan which is always referred to as fan 1 below is arranged in a housing 2. The fan 1 can be of any fan design.

The fan system 24 is to be understood in the sense of a compact modular component and can be an element of an arrangement with one or more fan systems which can advantageously be arranged directly adjacently and/or on top of one another, for example fan systems of a fan wall. A compact design is also produced thereby.

The housing 2 has a frame structure 3 which is closed laterally by side walls 4. On the inflow side, the housing 2 is closed off by a nozzle plate 5. In the nozzle plate 5, an inlet nozzle 23 for the fan 1 is attached or integrated. The fastening of the fan system 24 in a flow duct, in a ventilation system or on another fan system can occur via different elements of the housing 2, in particular via the nozzle plate 5, the frame structure 3 or the side walls 4.

FIG. 1 clearly shows that on the pressure side (outflow side) a particular device is provided, which is used for reducing or suppressing a backflow and for evening out the outflowing air. This device is referred to as backflow blocker 6 below. It is a component acting by fluid mechanics, which advantageously has an outer contour similar to the inner contour of the housing 2. In the embodiment example, the contours of the housing 2 and of the backflow blocker 6 are approximately square, viewed in the cross section perpendicularly to the fan axis. In particular, they can also be rectangular or hexagonal or have any other desired shape. The backflow blocker 6 takes up approximately 55% of the housing cross section, so that an annular duct 15 or air passage remains between the side walls 4 of the housing 2 and the backflow blocker 6. In other embodiments, the shape of the outer contour of the backflow blocker 6 can also differ clearly from the shape of the inner contour of the housing 2, as long as the backflow blocker in cross section takes up approximately 40%-70% of the housing cross section.

As shown in the embodiment example, in the area of the annular duct 15, the backflow blocker 6 advantageously has an axial height which is implemented by the frame 7. In particular, this axial height is greater than a metal plate thickness, advantageously greater than 5% of the width of the housing viewed in cross section or greater than 20% of the central width of the annular duct.

However, the backflow blocker 6 is nevertheless designed to be relatively thin in axial direction in comparison to the axial height of the housing 2. In order to achieve an optimal savings of installation space, the axial design height of the backflow blocker 6 is no greater than 20% of the axial design height of the fan system 24. In the embodiment example, it consists of a metal plate which is bent or crimped laterally to form a peripheral frame 7. The compact design is also produced thereby.

Centrally in the backflow blocker 6, an approximately round recess 8 is provided, through which a portion of the electromotor of the fan 1 protrudes. Thus it is possible to shift or to position the backflow blocker 6 sufficiently far beyond the fan 1 or the pressure-side end 9 thereof, so that the fan 1 itself and not, for example, the backflow blocker 6, with additional installation space, predetermines the necessary axial installation length of the fan system 24.

FIG. 1 moreover shows that the backflow blocker 6 is fastened on a mounting 10 which consists of round struts 11. On this mounting, the fan 1 with the electric motor thereof is also fastened, whereby the connection of the fan 1 to the housing is ensured. The struts 11 are each screwed via angle plates 12 to two side walls 4, whereby not only a mounting 10 for the fan 1 and the backflow blocker 6 but also a stabilization of the housing 2 is produced. Instead of the round struts 11 or round stock, thin sheet metal struts can also be used, wherein the use of round stock promotes the air flow or reduces the flow resistance.

Here, it should be noted that investigations have shown that the optimal geometry of the backflow blocker 6 does not depend or at most depends only marginally on the impeller type or on the impeller size of the fan 1. Instead, it is primarily the ratio of the cross-sectional areas of the housing 2 and of the backflow blocker 6 viewed in axial direction that is important. This finding allows the use of different fan impellers in the same housing or flow duct with the same backflow blocker 6, which has an advantageous effect on the production costs and the number of parts.

FIG. 1 shows moreover that the recess 8 which itself is circular, in the lower area, has a broadened recess 13 or notch, through which an electronics/control area 14 of the fan 1 is accessible from the pressure side, without removal of the backflow blocker. Irrespective of this, the backflow blocker 6 can be removed in accordance with the fastening device used, so that access to the entire fan 1 is possible without effort. The laying of the cables can occur through the recess 13, in order to allow the removal of the backflow blocker without effort without removal of the electrical connection cable.

FIG. 2 shows the compact fan system 24 from FIG. 1 in an axial top view, i.e., from the pressure side. Based on FIG. 2, it is possible to estimate approximately that the backflow blocker 6 takes up approximately 55% of the cross-sectional area of the housing 2. Due to the provision of the backflow blocker 6, in addition, the pressure-side sound level can be reduced, whereby the backflow blocker 6 is produced from sheet metal in the embodiment example shown here. It is also conceivable to coat the backflow blocker 6 with sound-absorbing material or to produce it entirely from this sound-absorbing material. It is also conceivable to produce the backflow blocker 6 from plastic, for example, by the injection molding method. Advantageously, foamed plastic can be used in order to save weight and in order to increase the sound absorption. In the case of cast backflow blockers 6, devices for fastening the backflow blocker on a mounting 10 can be integrated, allowing, for example, a simple clipping to the mounting 10.

FIG. 3 shows an additional embodiment example of a fan system according to the disclosure, but without the backflow blocker 6, so that a mounting 10 for the fan 1 can be seen uncovered. The mounting 10 includes vertical profiles 16 as well as lower and upper adjustment rails 17 for the variable axial positioning. The adjustment rails 17 are provided with oblong slots along which a shifting of the mounting 10 via the profiles 16 is possible. Thereby, it is possible to build different fans having different axial design height into a housing 2. Thus, the same fan impeller can be used with different motor construction lengths, or fans of different design or impeller type can be built into the same housing. Since, for the mode of operation of the backflow blocker, the ratio of its cross section to the housing cross section is crucial, the same backflow blocker can be used for different fans.

FIG. 4 shows the fan system according to FIG. 3, but with a backflow blocker 6, which will be mounted later, for example. It can be seen clearly that the axial position of the backflow blocker is always coupled to the axial position of the vertical strut 16 of the mounting 10. Thereby, an advantageous flow distance to the fan exit can be implemented independently of the fan used, without special additional measures.

FIG. 4 moreover clearly shows that a portion 9 of the electric motor of the fan 1 protrudes into the backflow blocker 6 or through the recess 8 in the backflow blocker 6, so that the provision of the backflow blocker 6 in no way increases the necessary installation space and thus the volume of the housing 2, whereby a retrofitting of conventional arrangements with a backflow blocker 6 is possible.

FIG. 5 shows the fan system from FIG. 4 in an axial top view, i.e., from the pressure side. There, the backflow blocker 6 is fastened from the pressure side with a total of four screws 18 on the mounting 10. In order to make the fan 1 accessible for maintenance or repair, the backflow blocker 6 can easily be removed by loosening the screws 18. Here, it should be noted that any other fastening variants are conceivable, for example, fastening by clipping, snapping in or clamping. Such fastening possibilities are advantageous particularly in the case of non-supporting embodiments of the backflow blocker 6, when this backflow blocker consists, for example, of foamed plastic.

As a particularly advantageous fastening variant, in the case of backflow blockers made of sheet metal, special clip elements have proven themselves, as is conventional likewise or similarly in the installation of empty cable conduits in electrical installation. On the one hand, these clip elements can be clipped into punch-outs provided for that purpose in the metal plate of the backflow blocker 6, and, on the other hand, they can also be clipped onto round struts 11 of a mounting 10. In exactly the same way, it is also conceivable to use similar clip elements for flat stock mountings which optionally have corresponding punch-outs.

FIG. 6 shows the fan system from FIGS. 1 and 2 from the side, wherein the side wall 4 has been removed on this side. In the background, the opposite side wall 4 can be seen.

The backflow blocker 6 provided there prevents air backflow prevents backflow of air toward the fan 1 in a central area near the axis. A toroidal loss-producing vortex cannot develop due to the provision of the backflow blocker 6.

Moreover, it should be noted that, in the embodiment example shown here, the duct width is 1.6× the maximum axial diameter of the impeller blades, wherein the range of this ratio can be typically between 1.3 and 1.8.

Moreover, FIG. 6 clearly shows the particular mounting 10 provided therein, which includes round struts 11 in the embodiment example.

FIG. 7 shows a view corresponding to FIG. 6, wherein this view relates to the embodiment example of FIGS. 3 to 5. The mounting 10 provided there includes vertical profiles 16 and adjustment rails 17 for optimal positioning.

FIGS. 8 and 9 show an additional embodiment example of a fan system, in each case in a diagrammatic view, and in particular FIG. 8 from the suction side and FIG. 9 from the pressure side. The fan system 24 has no housing and is used for the arrangement alone or with additional parallel-connected fan systems in a flow duct. This is a built-in system for a flow duct not shown in either of the two figures. Apart from that, the same explanations apply as in the above-described embodiment examples of the arrangement in a housing 2.

In the embodiment example shown in FIGS. 8 and 9, the backflow blocker 6 reduces the effective flow cross section in the flow duct, instead of in the housing 2 in accordance with the preceding embodiments. Other than that, the same explanations apply as before.

Here too, a mounting 10 made of round stock is provided. By use of this measure, the losses can be minimized. The backflow blocker 6 is produced from sheet metal and fastened, namely clipped, on the round stock or on the struts 10 of the fan mounting 10.

Advantageously, a backflow blocker 6 with its fastening device is designed so that it can be fastened both on a mounting 10 of a fan system 24 without housing and also on a mounting of a fan system 24 with housing 2, for example, according to FIG. 1. Thus, identical backflow blockers 6 can be used for the two types of fan systems.

The fan system 24 shown in FIGS. 8 and 9 can be built into an air handling unit with an axial flow duct, whereby the effect of the backflow blocker 6 comes into play most particularly, since in terms of flow a system is formed which is comparable to the embodiment example from FIGS. 1 and 2. The backflow blocker 6 is here advantageously designed so that it can be clipped both to a mounting 10 according to this figure and also to a mounting 10 according to FIGS. 1 and 2. In addition, the backflow blocker 6 can be attached optionally, in case it is needed. If the provision of the backflow blocker 6 is not desired, it can be removed or it can be omitted from the start. In any case, it can be retrofitted in each case in fans which are already located in the central air conditioning devices or the like. The same principle can also be implemented in mountings of different design, for example, based on a flat stock construction according to FIGS. 3 to 6.

Figure 12:
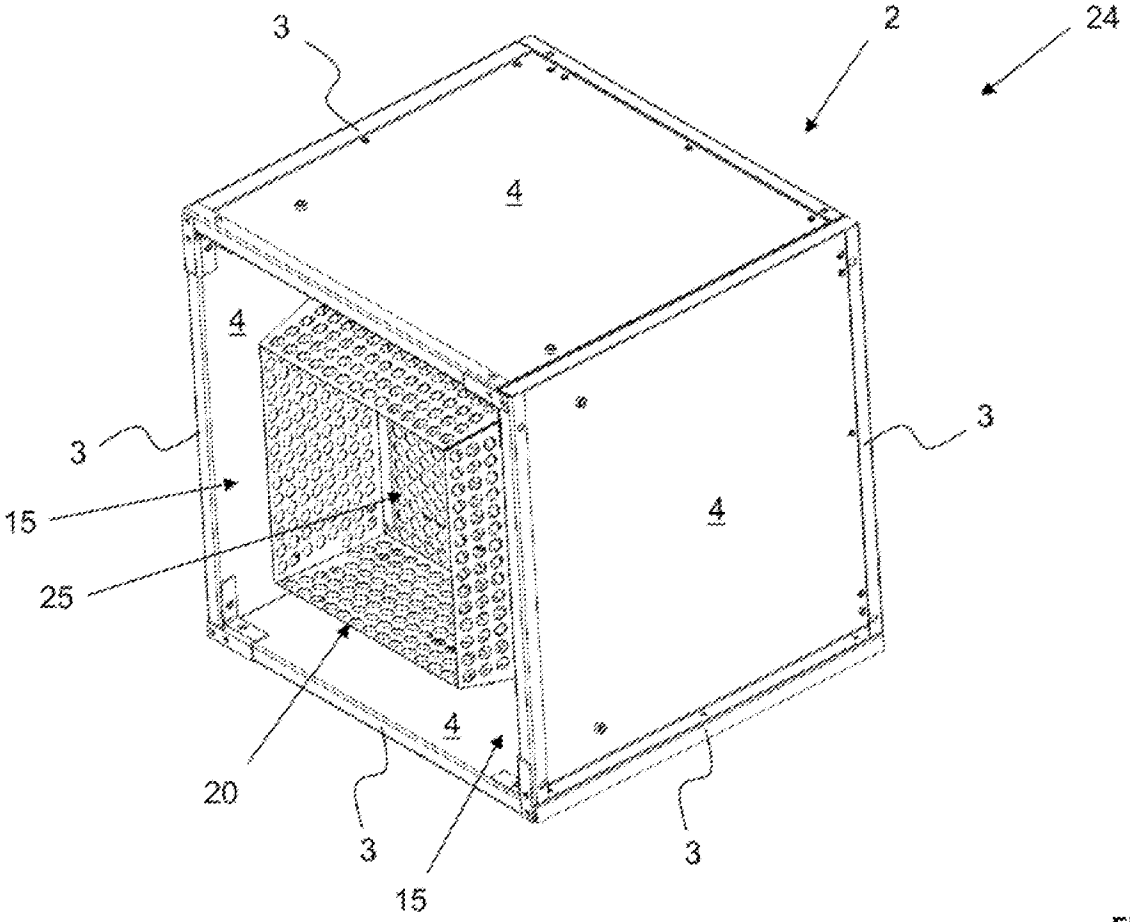
FIG. 12 shows, in a diagrammatic view, an additional embodiment example of a fan system according to the disclosure, wherein the fan 1 is arranged here in a housing 2.

On the pressure side, a sound absorber 20 consisting of perforated sheet metal is arranged, which is in contact with the backflow blocker not shown in FIG. 12 and reaches the pressure-side margin of the housing 2.

The sound absorber 20 consists of perforated sheet metal, wherein in the inner central area 25 surrounded by the perforated metal plate, a sound-absorbing material can be used. It is also conceivable to produce the sound absorber 20 entirely from a dimensionally stable sound-absorbing material.

Figure 13:
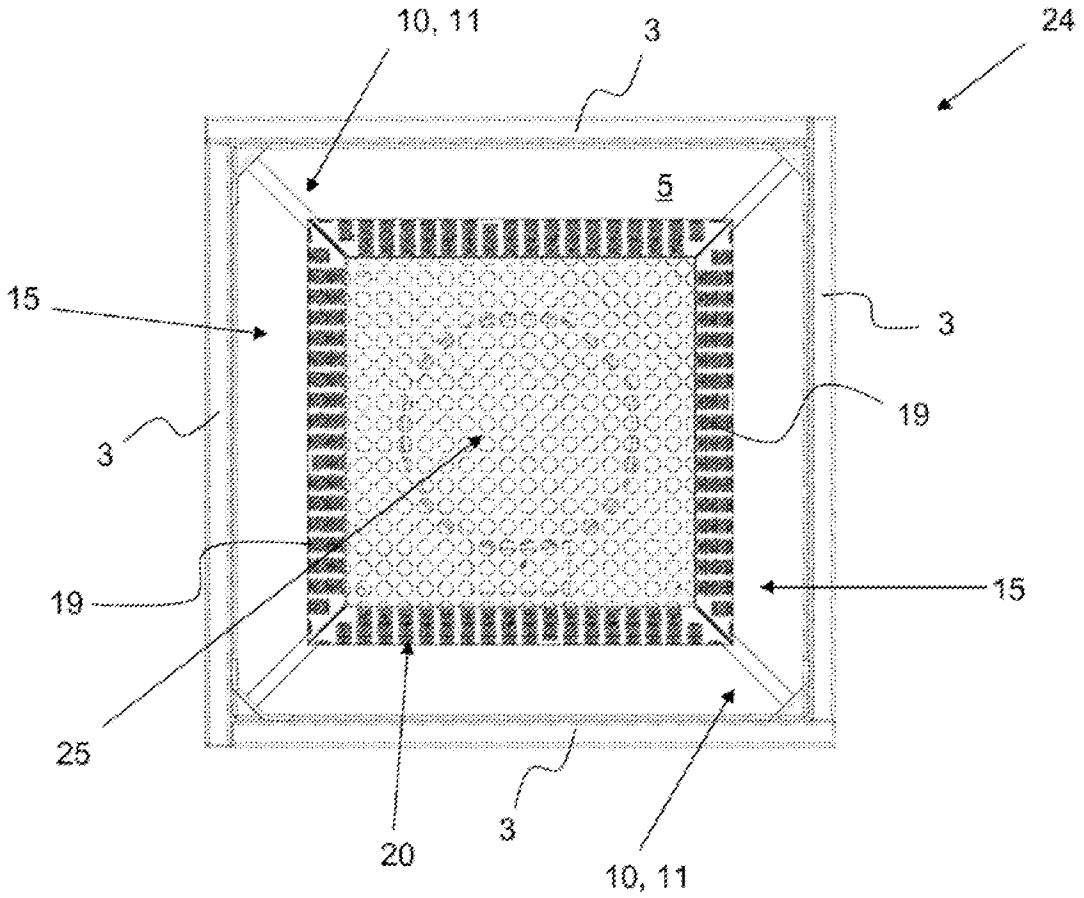

FIG. 13 shows the fan system from FIG. 12 in a top view from the pressure side. The perforated sound absorber 20 can be seen easily, particularly in that it is in contact with the backflow blocker 6 due to identical shape. The mounting 10 with round struts 11 can also be seen.

Figure 14:
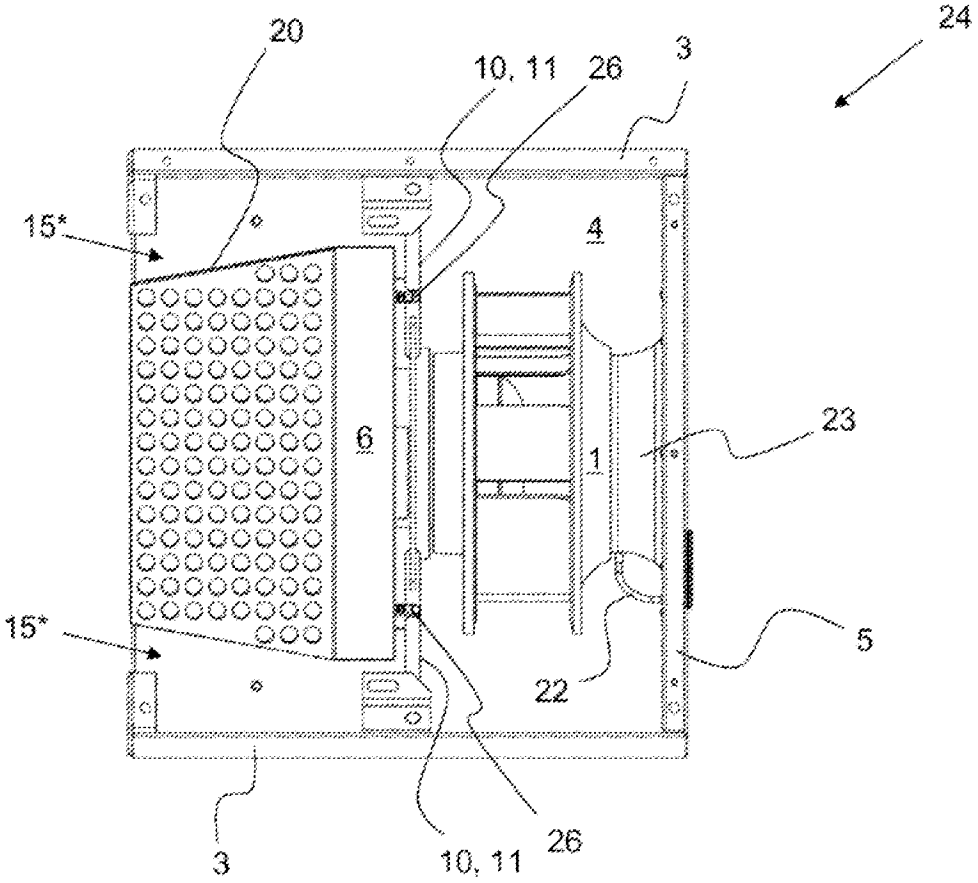

FIG. 14 shows the fan system from FIGS. 12 and 13 from the side with side walls removed. Here too, it can be clearly seen that the sound absorber 20 is in direct contact with the backflow blocker 6, wherein both components are fastened together and positioned via the mounting 10. In FIG. 14, it can easily be seen that the backflow blocker 6 is fastened by a simple clip connection 26 to the struts 11 of the mounting 10. The sound absorber 20 acts with respect to the air flow from its outer side.

Here too, the axial position of the mounting 10 can be adjusted and configured to different fans 1. On the inlet nozzle 23, a decompression device 22 is provided, which can be used for volume flow measurement during the operation of the fan 1.

In the embodiment example shown in FIGS. 12 to 14, the sound absorber 20 is in the form of a truncated pyramid. Thereby, between the side walls 4 and the sound absorber 20 or its wall 19, broadening flow ducts 15* in the sense of a diffuser are formed, which are used for converting dynamic energy into pressure energy. Thereby, an increase in efficiency can be brought about, wherein an optimal positioning of both the fan 1 and the backflow blocker 6 including sound absorber 20 is a prerequisite.

In particular in the case of different housing cross sections, broadening flow ducts 15* can also be implemented by sound absorbers having a shape different from the truncated pyramid, for example, the form of a truncated cone.

The sound absorber 20 can also be a cuboid, so that no diffusers are formed. In any case, by the use of the sound absorber 20, sound power radiated into a duct system can be reduced. The outer square flow path of the housing 2 extends from the backflow blocker 6 viewed in axial direction over the entire active surface of the sound absorber 20, wherein it is also conceivable that the sound absorber 20 extends out of the housing 2 into a flow duct, wherein, in the installed state, for example in an air handling unit, this flow duct is then surrounded by duct walls similar to the side walls 4 of the housing 2, whereby the sound absorber 20 can have its effect.

Figure 1:
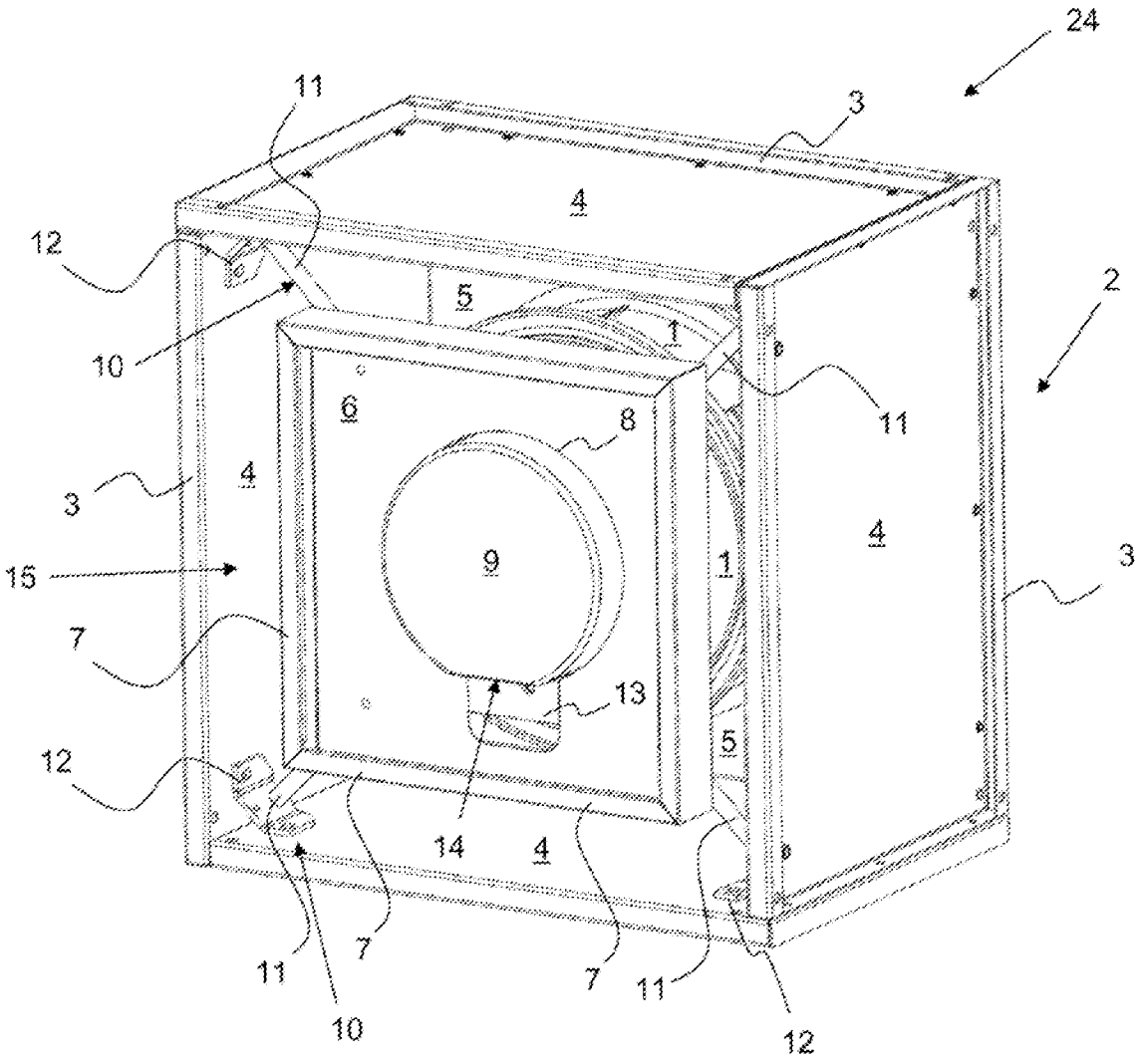
Figure 2:
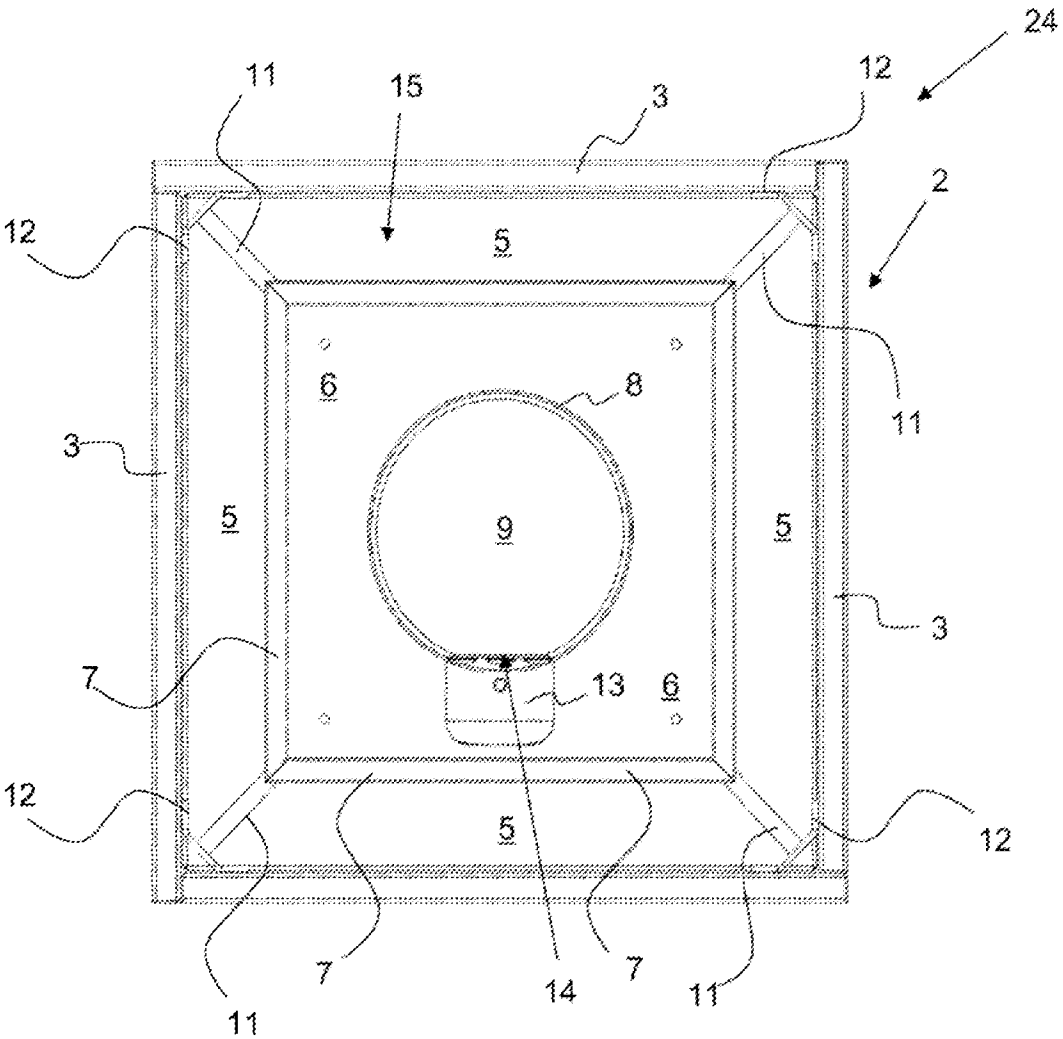

The outer walls 4 of the housing 2 can also be designed as sound absorbers. This is possible, for example, in that, as outer walls 4, panels of sound-absorbing material are used. It is also possible to produce the outer walls 4 from perforated sheet metal and to attach a sound-absorbing material outside of the flow path. In radial direction (transverse to the side wall 4) space is available for this purpose, which is the result of the design height of the frame structure 3 transverse to the housing side wall 4, as can be seen clearly in FIG. 1, for example.

Figure 15:
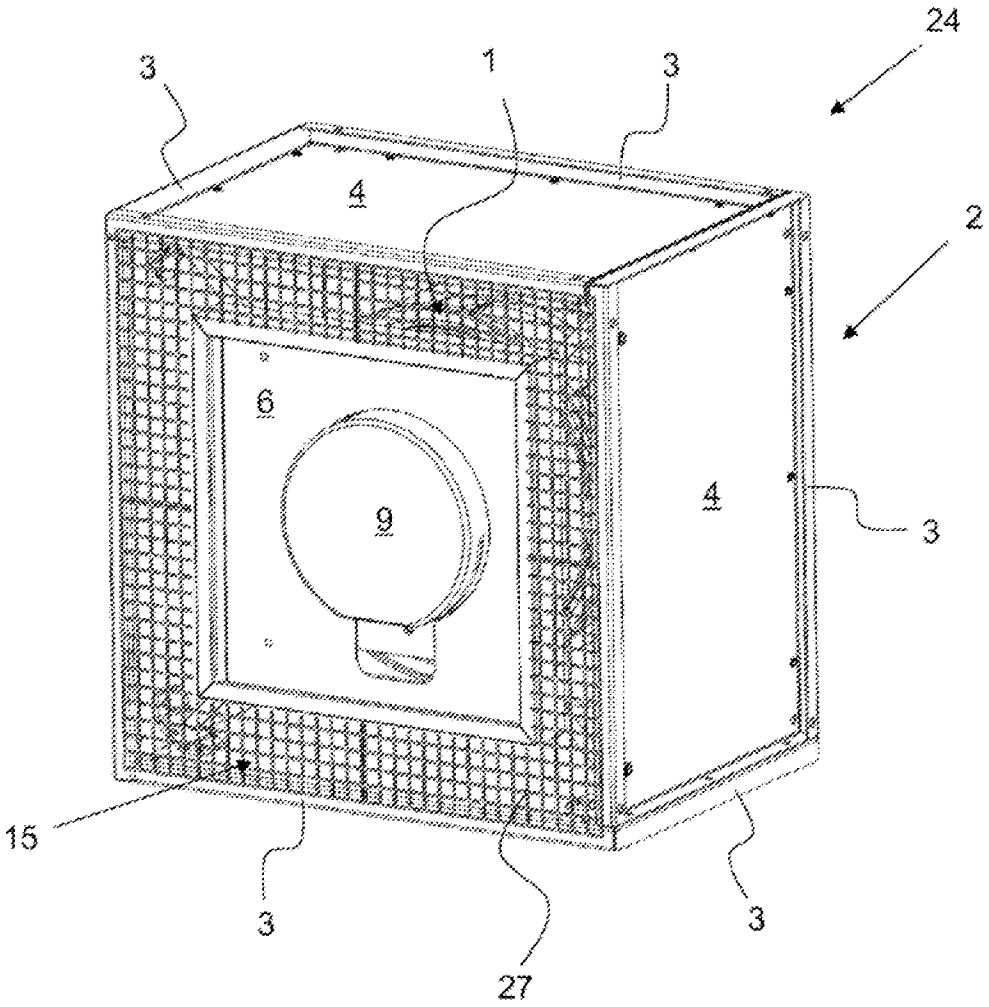

FIG. 15 shows an additional embodiment example of a fan system 24 with a backflow blocker 6. In this embodiment example, a pressure-side contact protection 27 in the form of a contact protection grate is integrated on the fan system 24. A pressure-side contact protection is necessary if the outflow side of a fan system 24 can be accessible during fan operation. Since the backflow blocker 6 for the inner area near the axis protects one from contact with the fan, the additional contact protection 27 can be limited to the areas of the annular duct 15, which contributes to the savings of material and weight. Since the distance of the contact protection 27 to the rotating parts of the fan 1 in the area of the pressure side outlet of the annular duct 15 is relatively large, large grate mesh widths can be selected, which is advantageous for the efficiency and noise generation. The contact protection 27 can be designed other than as a punched metal plate, with a mesh grate structure or a wire ring grate structure. The fastening can occur on the housing 2, on the backflow blocker 6 or on both, and, namely, optionally with screws, rivets, clips, locking hooks or the like. Apart from that, this embodiment example is comparable to the one according to FIG. 1, for example.

Figure 16:
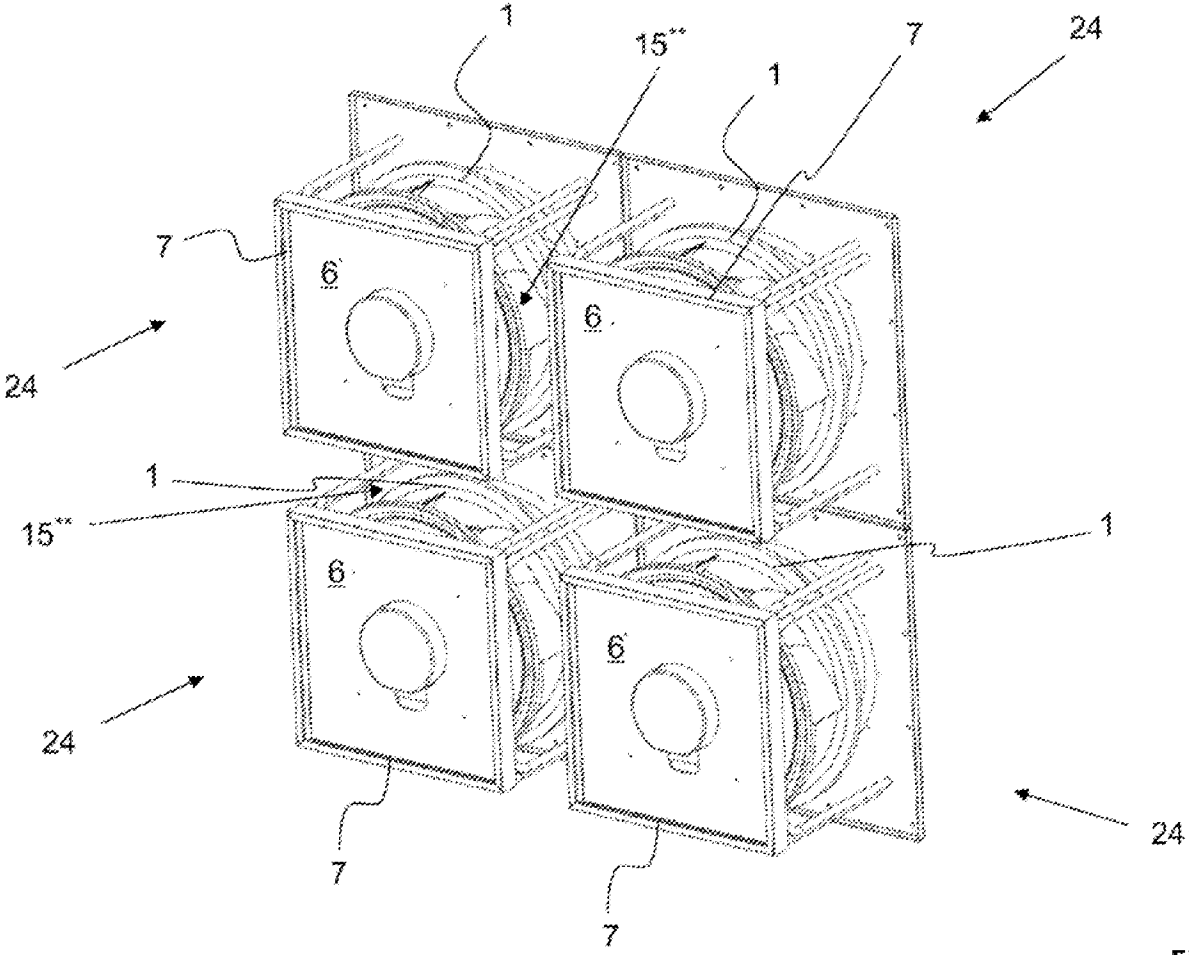

In FIG. 16, an advantageous arrangement of four fan systems 24 according to FIGS. 8 to 11 is represented. These are fan systems 24 without housing, which are connected in parallel arranged next to one another. This arrangement could be used, for example, in a flow duct which surrounds the entire arrangement. A special feature in this arrangement consists in that there are no side walls at all between adjacently arranged backflow blockers 6. Instead of annular ducts 15, as in fan systems with housing, flow ducts 15 form between adjacent backflow blockers. In this arrangement as well, the backflow blockers 6 bring about similar advantages as in the case of embodiments with housing. In central areas near the axis behind the fans 1, backflow is reduced or prevented, the efficiency is increased, and the noise emission is reduced. The compactness of the arrangement is due to the small lateral spacing of the fan systems 24, whereby an axial forward flow of the air is forced and the use of backflow blockers 6 is advantageous. The use of backflow blockers 6 is particularly advantageous in adjacent fan systems 24 without housing if an axial spacing of adjacent fans 1 is less than 1.6×D, wherein D is the largest diameter of a fan blade of the fans 1** in question.

Figure 3:
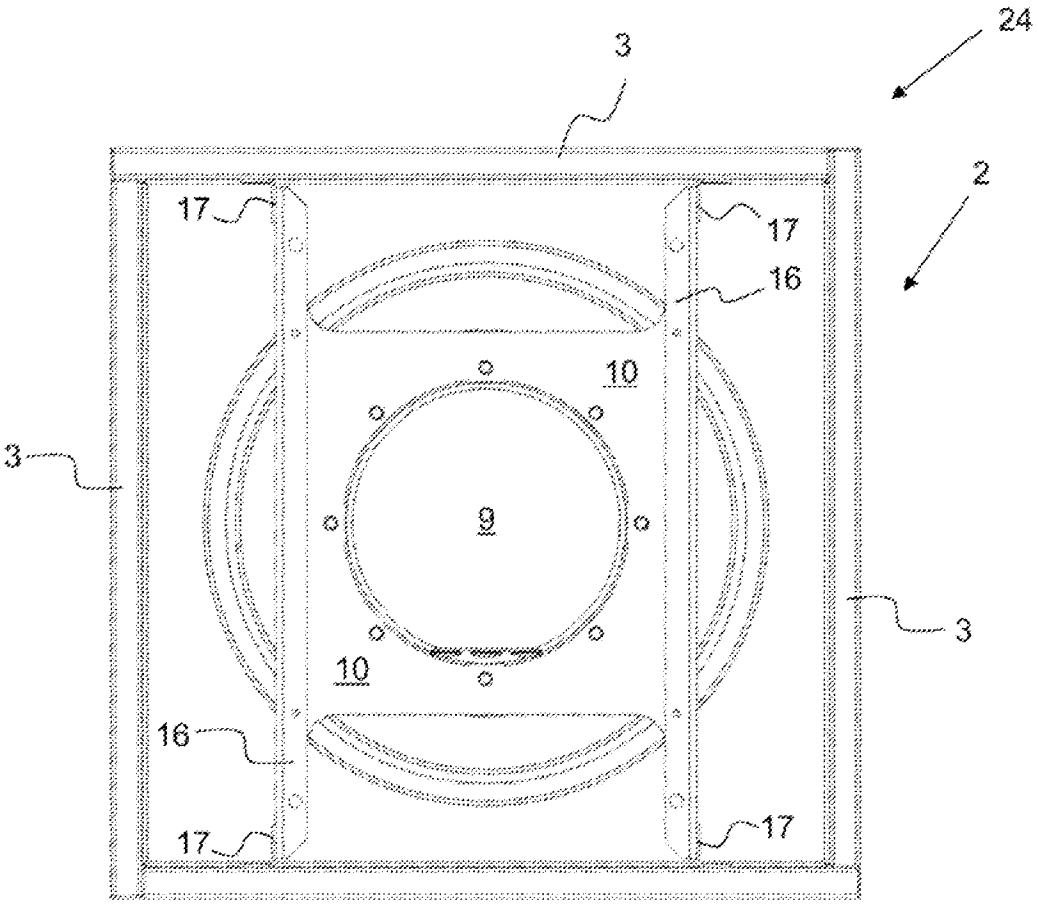
Figure 4:
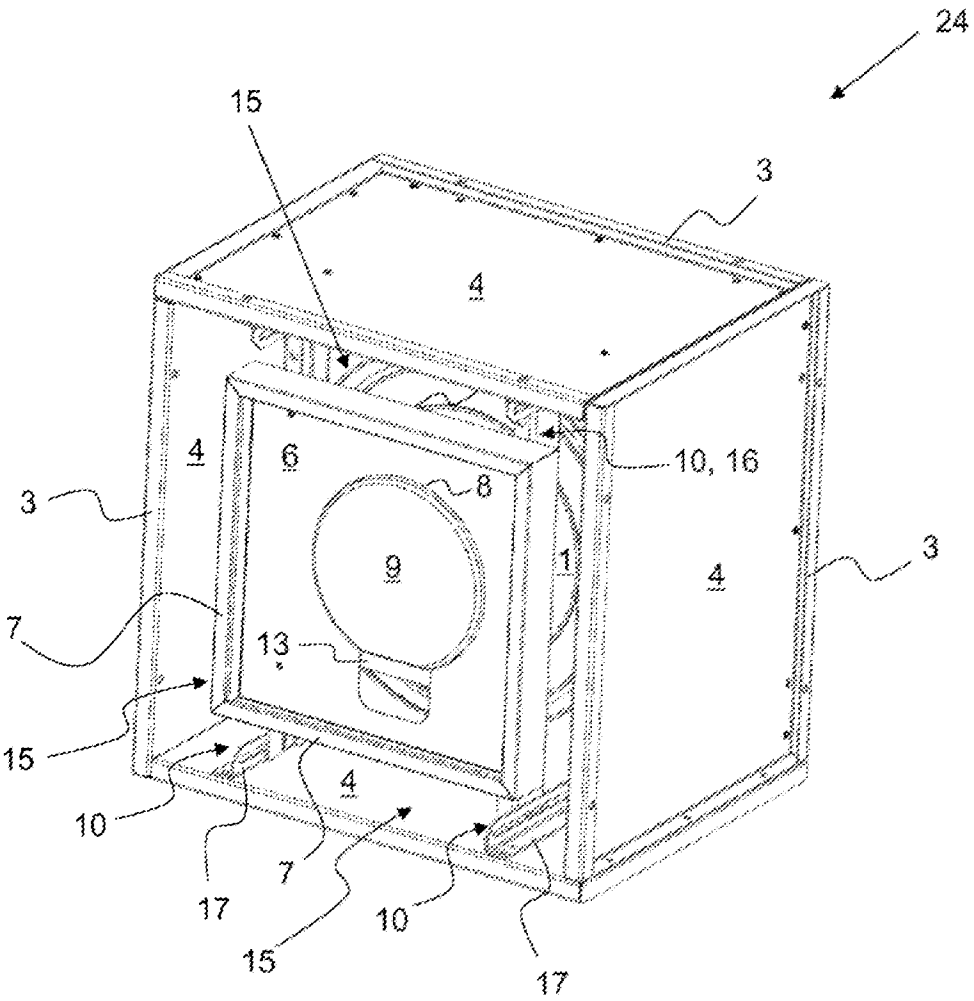
Figure 5:
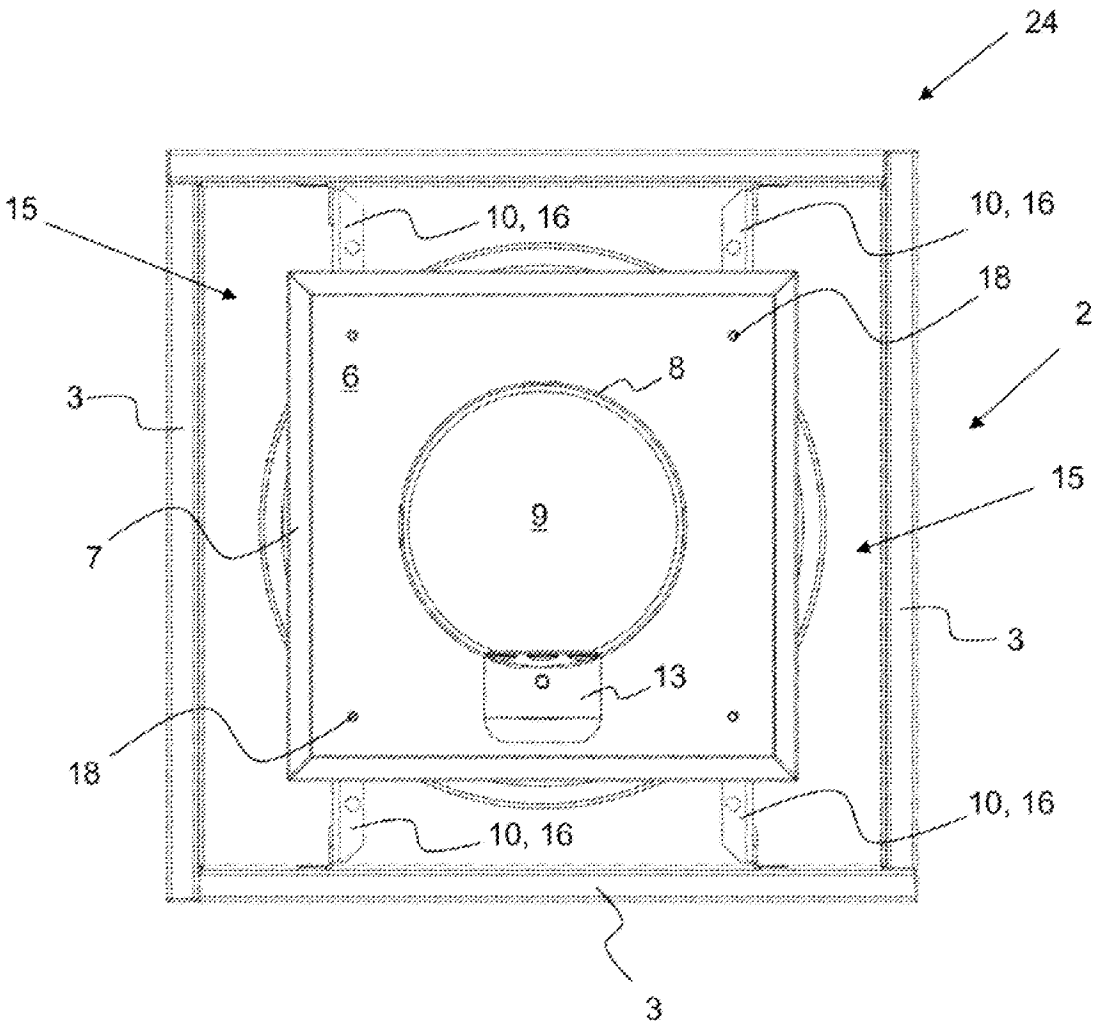
Figure 6:
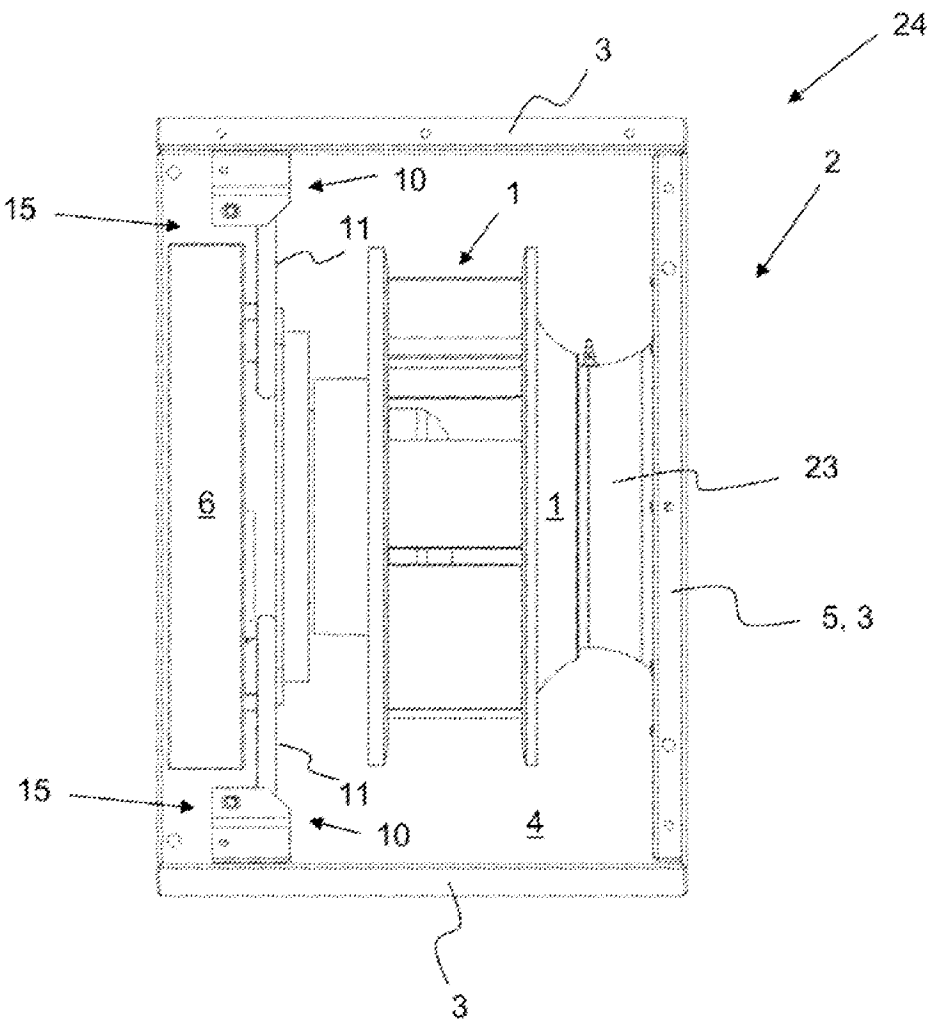
Figure 7:
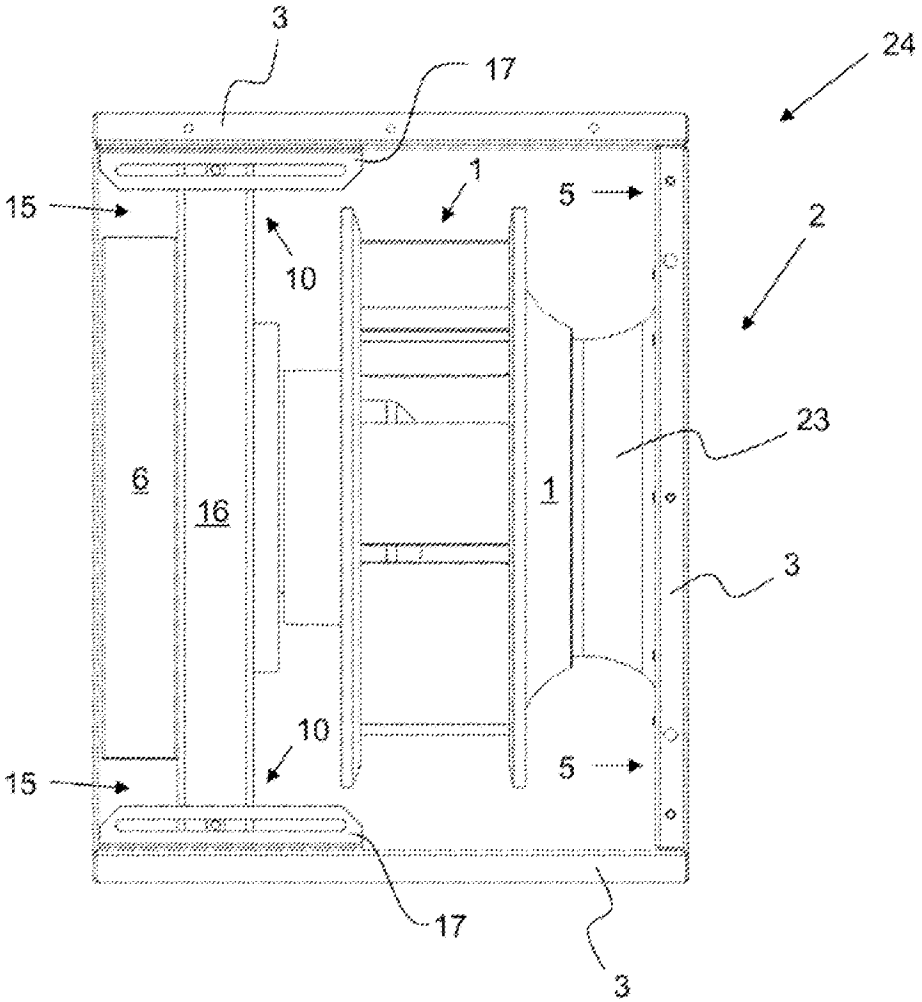
Figure 8:
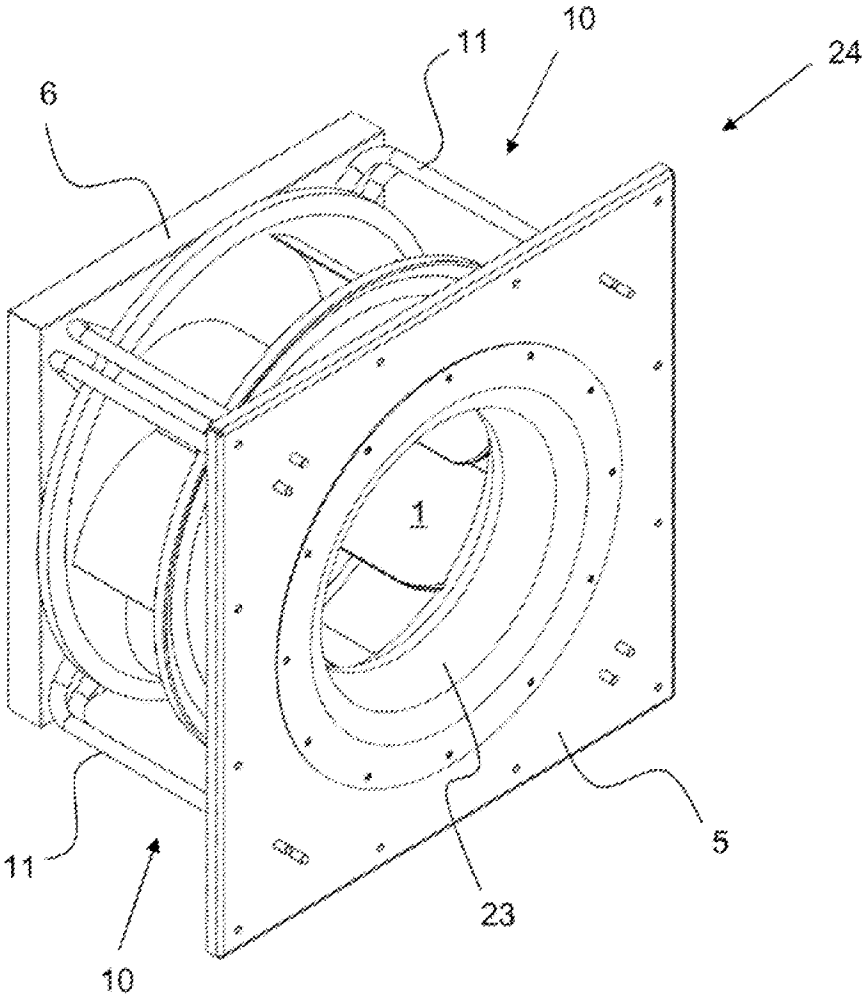
Figure 9:
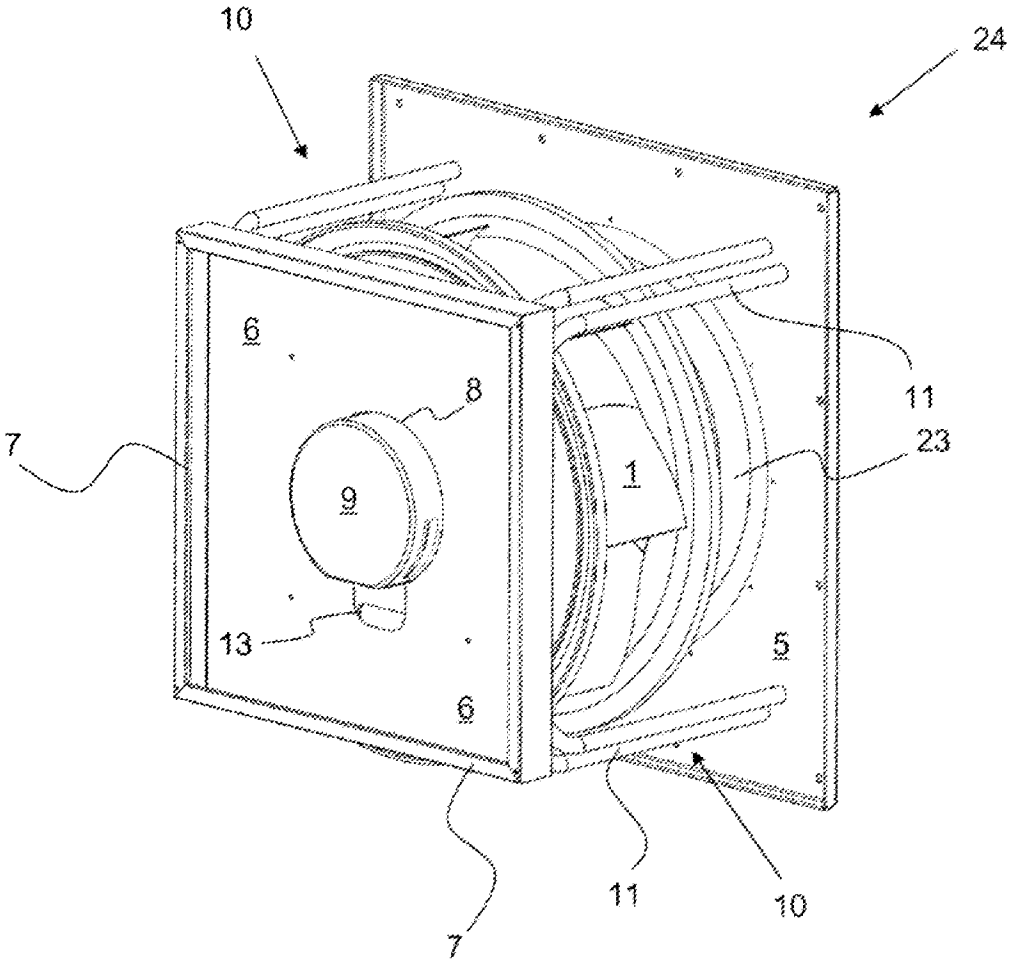
Figure 10:
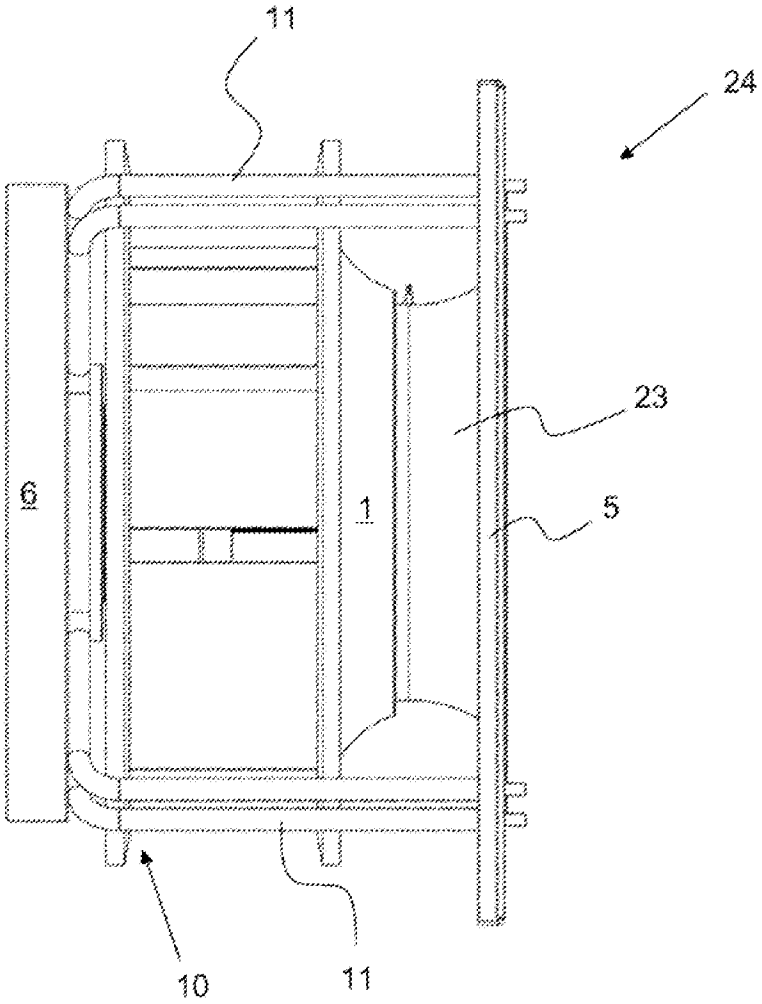
FIG. 10 shows the fan system from FIGS. 8 and 9 from the side, wherein here the mounting 10 can be seen particularly clearly.
Figure 11:
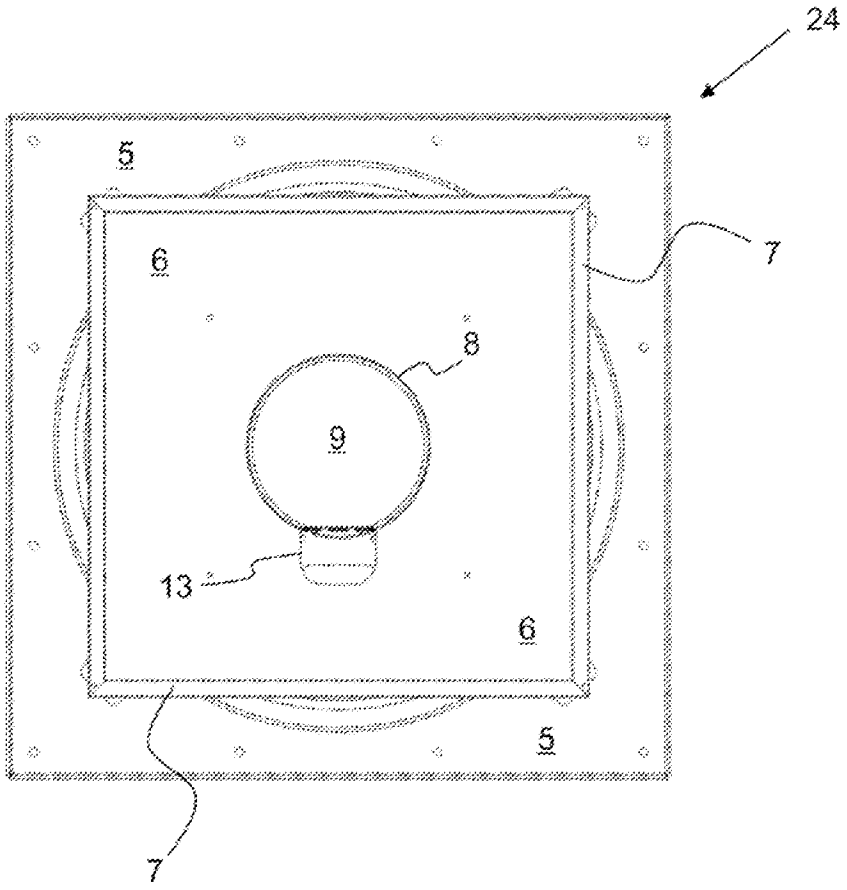
FIG. 11 shows the object from FIGS. 8, 9 and 10 in a top view from the pressure side, wherein the backflow blocker 6 can here be seen from the front.
Figure 17:
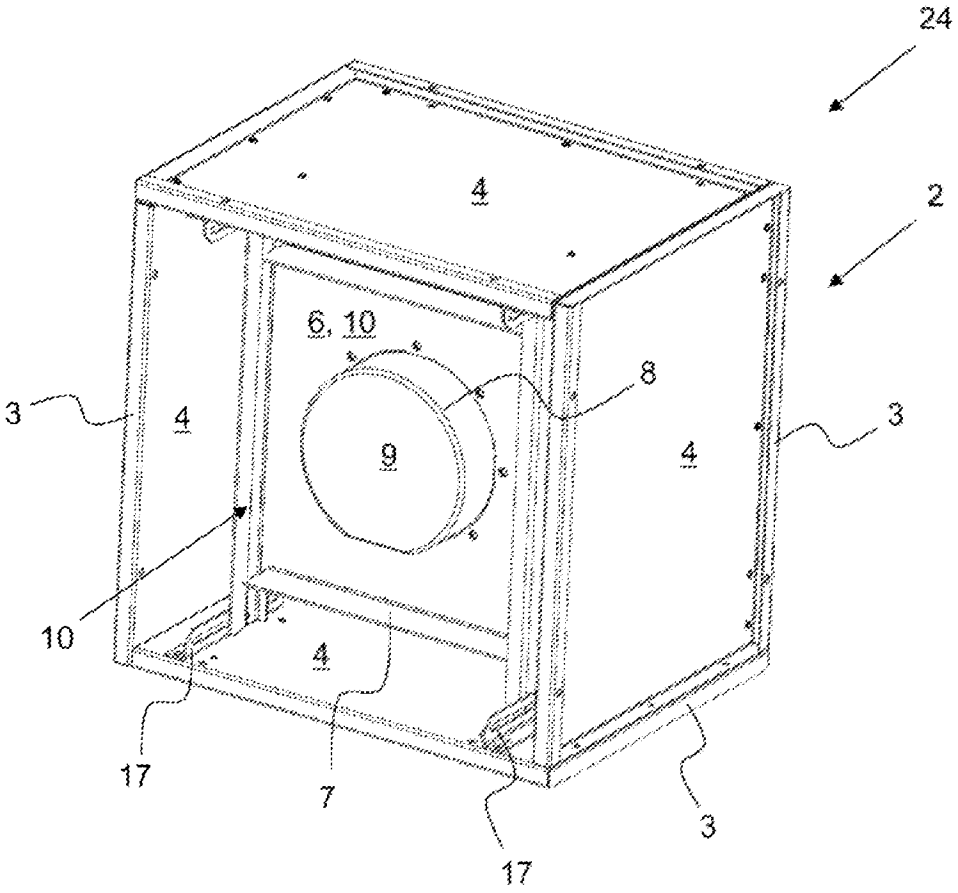

Finally, in FIG. 17, an additional embodiment of a fan system 24 with housing 2 and backflow blocker 6 is represented. In this embodiment example, the backflow blocker 6 is implemented as a supporting part and is integrated in the fan mounting, i.e., fan mounting 10 and backflow blocker 6 are one and the same sheet metal part. To that extent, the mounting 10 here assumes a function with a positive effect in terms of flow mechanics. The fan is fastened via its motor to the supporting backflow blocker 6, 10 in a manner similar to the one described in FIG. 3, wherein the pressure-side end 9 of the motor protrudes through a recess 8 into the supporting backflow blocker 6, 10. An advantage of such an embodiment is that fewer parts are necessary for the construction, since the functions of the backflow blocker 6 and of the mounting 10 are performed by the same part. However, a disadvantage is that the backflow blocker 6 has to be produced from a strong sheet metal in order to be able to assume the supporting function. For static reasons this would actually not be necessary over the entire dimensions of the backflow blocker 6.

To that extent, mixed forms are also conceivable, in which a supporting portion of the backflow blocker 6 is produced from strong sheet metal, and non-supporting parts are produced from weaker sheet metal. However, this again leads to a higher number of parts.

With regard to additional advantageous designs of the teaching according to the disclosure, in order to avoid repetitions, reference is made to the general part of the description and to the added claims.

Finally, it is explicitly pointed out that the above described embodiment examples of the teaching according to the disclosure are used only for explaining the claimed teaching, but do not limit said teaching to the embodiment examples.

LIST OF REFERENCE NUMERALS

1 Fan, radial fan
2 Housing
3 Frame structure
4 Side wall
5 Nozzle plate
6 Backflow blocker
7 Frame (of the backflow blocker)
8 Recess (of the backflow blocker)
9 Pressure-side end of the fan motor
10 Mounting
11 Struts
12 Angle plate
13 Additional recess in the backflow blocker
14 Electronics/control area of the fan
15 Annular duct

15* Annular duct that broadens in the manner of a diffuser
15** Flow duct between adjacent fan systems or backflow blockers
16 Vertical profile of the mounting
17 Adjustment rail
18 Screw
19 Wall
20 Sound absorber
21 Not assigned
22 Decompression device
23 Inlet nozzle
24 Fan system
25 Area for sound-absorbing material
26 Clip connection
27 Contact protection, contact protection grate

The invention claimed is:

1. A fan system, comprising:

a housing including side walls, an inflow side, and an outflow side;

at least one fan secured in the housing;

a backflow blocker adjustably mounted to the housing by a mounting on the outflow side of the housing, the backflow blocker being configured to reduce or suppress backflow of air flowing out of the fan system, wherein the backflow blocker is configured as a flat box that is centered in a flow path of the fan system to partially block a cross-section of the flow path such that an annular passage is formed between side walls of the housing and side walls of the backflow blocker such that air can flow through the annular passage;

wherein the backflow blocker has an axial height that is greater than 5% of a width of the housing, and that is less than 20% of an axial design height of the fan system; and wherein the mounting is configured such that a position of the backflow blocker within the housing can be adjusted.

2. The fan system according to claim 1, wherein the backflow blocker has a largest effective surface that extends transversely or orthogonally to a flow direction of the fan system.

3. The fan system according to claim 1 wherein, viewed in an axial direction, an outer contour or cross-sectional shape of the backflow blocker is substantially equal to or similar to an inner contour or cross-sectional shape of the housing or of a surrounding flow duct.

4. The fan system according to claim 1, wherein, viewed in an axial direction, an inner contour of the housing or of a surrounding flow duct is square or rectangular in cross section, and wherein the backflow blocker is correspondingly square or rectangular in cross section viewed in the axial direction.

5. The fan system according to claim 1, wherein an inner contour of the housing or of a surrounding flow duct is round in cross section viewed in an axial direction, and wherein the backflow blocker is accordingly round in cross section viewed in axial direction.

6. The fan system according to claim 1, wherein the backflow blocker further comprises a central recess or passage and the at least one fan further comprises a motor, wherein the backflow blocker and the at least one fan are configured such that a pressure-side area of the motor of the at least one fan protrudes into or through the recess or passage of the backflow blocker.

7. The fan system according to claim 1, wherein the backflow blocker is configured to block the cross-section of the flow path by 40% to 70%.

8. The fan system according to claim 7, wherein the backflow blocker is configured to reduce the cross-section of the flow path by approximately 55%.

9. The fan system according to claim 1, wherein the backflow blocker is configured as a sound-absorbing component, and includes sound-absorbing material.

10. The fan system according to claim 9, wherein the backflow blocker consists of sound-absorbing material.

11. The fan system according to claim 1, further comprising a nozzle plate mounted to the side walls on the inflow side of the housing, thereby closing the inflow side of the housing, wherein the backflow blocker is configured to be a component of a mounting which fastens the at least one fan to the housing or fastens the at least one fan to the nozzle plate.

12. The fan system according to claim 1, wherein the mounting for the backflow blocker also mounts the at least one fan to the housing.

13. The fan system according to claim 12, wherein the backflow blocker is screwed to the mounting or clipped, snapped in, or clamped, to the mounting.

14. The fan system according to claim 1, wherein the mounting includes round stock or flat stock.

15. The fan system according to claim 1, further comprising a nozzle plate mounted to the side walls on the inflow side of the housing, thereby closing the inflow side of the housing, wherein the mounting allows a position of the backflow blocker to be adjusted axially relative to the nozzle plate in a direction toward or away from the nozzle plate.

16. The fan system according to claim 1, wherein the backflow blocker includes sheet metal, plastic, or surface-structured and/or foamed plastic.

17. The fan system according to claim 1, further comprising a nozzle plate mounted to the side walls on the inflow side of the housing, thereby closing the inflow side of the housing.

18. A system, comprising:

a fan system installed in a flow duct of a ventilation system, wherein the fan system includes:

a housing including side walls, an inflow side, and an outflow side;

at least one fan secured in the housing;

a backflow blocker adjustably mounted to the housing by a mounting on the outflow side of the housing, the backflow blocker being configured to reduce or suppress backflow of air flowing out of the fan system, wherein the backflow blocker is configured as a flat box that is centered in a flow path of the fan system to partially block a cross-section of the flow path such that an annular passage is formed between side walls of the housing and side walls of the backflow blocker such that air can flow through the annular passage;

wherein the backflow blocker has an axial height that is greater than 5% of a width of the housing, and that is less than 20% of an axial design height of the fan system, and wherein the mounting is configured such that a position of the backflow blocker within the housing can be adjusted.

19. The system according to claim 18, wherein a distance of a wall of the flow duct or of a side wall of the housing to a fan axis is less than 0.8 times a largest diameter of an impeller blade of the fan.

20. The system according to claim 18 further comprising at least two fan systems that are positioned next to one another.

21. The system according to claim 18, further comprising two adjacent fan systems having housings that are in direct contact with one another or that are fastened to one another.

22. The system according to claim 18, further comprising two adjacent fan systems separated by an axial distance which is equal to or less than 1.6 times a largest diameter of an impeller blade of the at least one fan of each of the fan systems.

23. The system according to claim 18, further comprising one or more fans having no housing.

24. The system according to claim 18, further comprising a heat exchanger positioned downstream of the backflow blocker on a pressure side.

25. The fan system according to claim 18, further comprising a nozzle plate mounted to the side walls on the inflow side of the housing, thereby closing the inflow side of the housing.

* * * * *